United States Patent [19]

Flockenhaus et al.

[11] 4,369,094

[45] Jan. 18, 1983

[54] METHOD OF PREVENTING THE ENTRY OF AIR INTO THE HOUSING OF A CHARGING DEVICE WHICH CONVEYS COAL

[75] Inventors: Claus Flockenhaus, Essen; Günter Gabriel, Datteln, both of Fed. Rep. of Germany; Günter Ziolkowski, deceased, late of Essen-Byfang, Fed. Rep. of Germany, by Dagmar Ziolkowski, heir; Paul-Heinz Heesen, Bochum, Fed. Rep. of Germany; Joachim F. Meckel, Heiligenhuas, Fed. Rep. of Germany; Manfred Galow, Essen, Fed. Rep. of Germany

[73] Assignees: Bergwerksverband GmbH; Didier Engineering GmbH, both of Essen, Fed. Rep. of Germany

[21] Appl. No.: 329,565

[22] Filed: Dec. 10, 1981

Related U.S. Application Data

[63] Continuation of Ser. No. 93,711, Nov. 13, 1979, abandoned.

[30] Foreign Application Priority Data

Nov. 18, 1978 [DE] Fed. Rep. of Germany ..... 2850103

[51] Int. Cl.[3] ..... C10B 31/00; C10B 41/00

[52] U.S. Cl. ..... 201/41; 202/262

[58] Field of Search ..... 201/10, 40, 41; 202/262; 406/197; 48/DIG. 4; 414/190, 196–198, 786

[56] References Cited

U.S. PATENT DOCUMENTS

| | | | |
|---|---|---|---|
| 2,662,816 | 12/1953 | Kalbach | 48/DIG. 4 |
| 3,432,398 | 3/1969 | Schmidt | 201/40 |
| 3,457,141 | 7/1969 | Schmidt | 201/40 |
| 3,761,360 | 9/1973 | Auvil et al. | 201/40 |
| 4,017,269 | 4/1977 | Dutz et al. | 48/DIG. 4 |
| 4,060,458 | 11/1977 | Davis | 202/262 |
| 4,146,370 | 3/1979 | van Herwijnen et al. | 48/DIG. 4 |
| 4,165,260 | 8/1979 | Bugajski et al. | 202/262 |
| 4,176,011 | 11/1979 | Knappstein | 201/41 |

*Primary Examiner*—Bradley Garris

*Attorney, Agent, or Firm*—Michael J. Striker

[57] ABSTRACT

Superheated steam is continuously made to flow through the housing of a device which conveys coal from a bunker to the charging holes of coke ovens. While no charging takes place, the steam is vented from the housing and condensed. When charging does take place, the steam enters the coke oven with the coal, is then discharged from the coke oven, and thereupon condensed. The pressure of the steam in the housing may be greater than ambient atmospheric pressure and/or the pressure of the coking gas in the oven, to reliably prevent the entry of the air and/or the gas into the housing and thus to avoid the formation of dangerous gas mixtures therein.

6 Claims, 2 Drawing Figures

METHOD OF PREVENTING THE ENTRY OF AIR INTO THE HOUSING OF A CHARGING DEVICE WHICH CONVEYS COAL

This is a continuation of application Ser. No. 093,711, filed Nov. 13, 1979, now abandoned.

BACKGROUND OF THE INVENTION

1. Field of the Invention

This invention relates to coke oven operations.

More particularly, the invention relates to a method of charging coke ovens with particulate coal.

Specifically, the invention relates to a method of preventing the entry of air and/or other gases into the housing of a mechanical charging apparatus for a coke oven.

2. The Prior Art

Coke ovens are usually arranged side-by-side to form coke oven batteries. Each oven has in its ceiling one or more charging holes through which particulate coal to be coked is admitted into the oven chamber.

Various ways are known of transporting the coal from the coal bunker or hopper to these charging openings. For example, it is known to employ scraper—chain conveyors, vibratory conveyors or pneumatic conveyors. In all instances, the coal transporting devices have a closed housing through which the coal advances from the bunker to the chamber inlet openings; this is, inter alia, to prevent the escape of coal dust to the ambient atmosphere.

A major disadvantage of the prior art heretofore has been the fact that ambient air and/or oven fill gases evolving during filling of the oven chamber, can enter the housing of the coal transporting (i.e. oven charging) apparatus, with the attendant danger that explosive mixtures of gas and oxygen may form therein.

SUMMARY OF THE INVENTION

Accordingly, it is an object of the invention to overcome these prior-art disadvantages.

A more particular object of the invention is to render such charging apparatus inert with respect to the formation of combustible and/or explosive mixtures therein.

In keeping with these objects, and others which will become apparent hereafter, one aspect of the invention resides in a method of preventing the entry of air and/or other gases into the housing of a coke-oven charging apparatus. Briefly stated, the method may comprise the steps of causing superheated steam to flow continuously through the housing in the coal conveying direction; continuously discharging the steam from a downstream position of the housing while no coal is being charged, and effecting condensation of the steam outside the housing; and during charging of coal into a coke oven chamber admitting the steam with the coal into the chamber, and thereupon venting it into the coke oven main and effecting condensation of the steam.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 2:
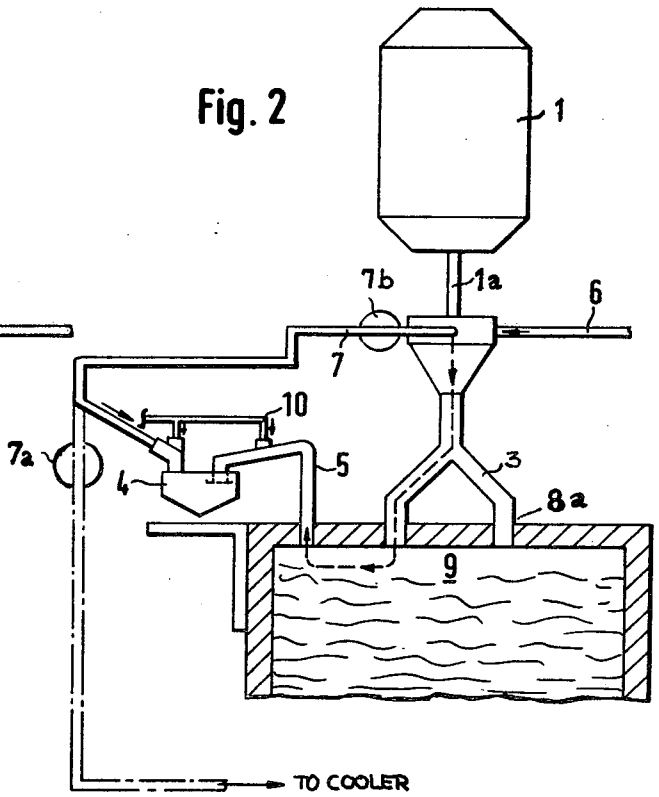
FIG. 2 is a vertical section through the apparatus in FIG. 1.
Figure 1:
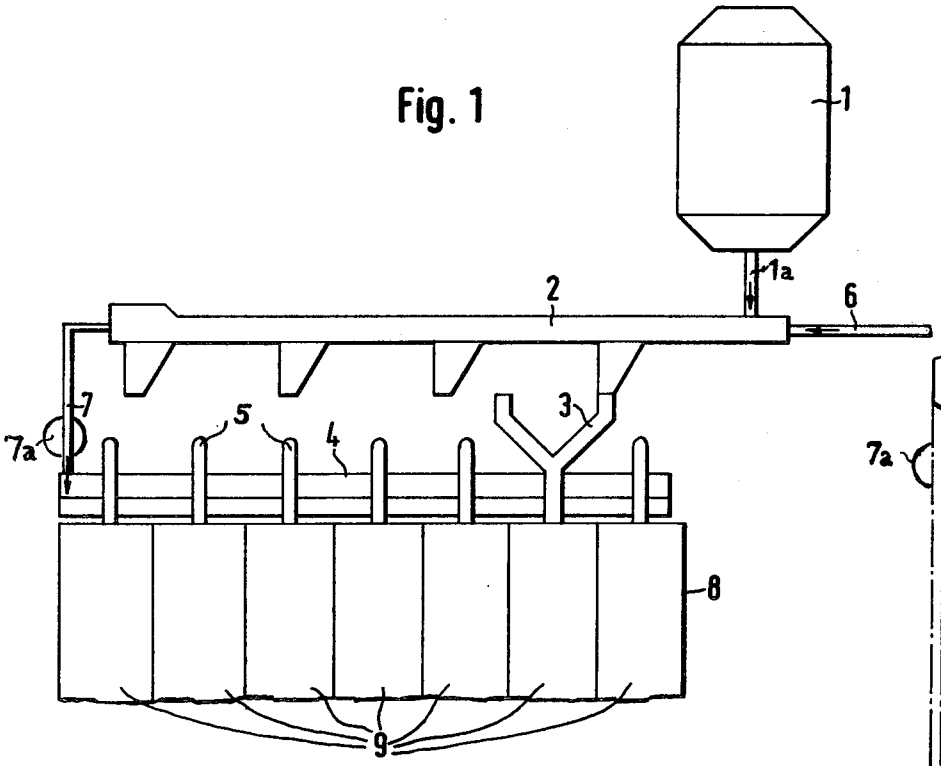
FIG. 1 is a fragmentary side elevation of a coke oven battery with a charging apparatus adapted to carry out the invention.

The drawing shows in FIG. 1 a battery of coke ovens 8 each having an interior coke oven chamber 9 (see FIG. 2). Each oven 8 is provided in its ceiling with one or more (two shown in FIG. 2) filling openings 8*a* through which particulate coal is charged into the oven chamber. There are, of course, closures which block these openings except at the time of charging, but these are known per se and therefore require no illustration or discussion. A bunker or hopper 1 is provided which contains particulate coal to be charged into the respective chambers 9.

The charging is effected by a mechanical charging device 2, for example a closed-housing scraper conveyor or any other device conventionally used for this purpose. The device 2 is connected with bunker 1 via a conduit 1*a* through which it receives coal from the bunker. It then conveys this coal to the area above the battery of ovens 8 and discharges it into whichever of the chambers 9 requires filling. In the illustrated example this takes place via the chute 3, but other ways are also known (e.g. a direct discharge from device 2 into holes 8*a*) and usable in the context of the invention.

A conduit 6 comunicates with the housing of device 2 and discharges superheated steam into it. Suitable valves (not shown, because known per se) are provided to produce in the housing a steam pressure which is slightly greater than the pressure of coking gas in the chambers 9. Since the coking gas pressure in turn is greater than ambient atmospheric pressure, it follows that the overpressure in the housing of device 2 prevents the entry of both air and coking gas into the housing.

Steam, of course, is inert in the sense required by the present invention, in that it will not form explosive or combustible mixtures. Other inert gases could be used instead, but steam has the advantage of being a by-product of coke making, i.e. an excess supply of low-pressure steam is always abundantly available in coking plants. This makes the inventive method economically very attractive.

During the times in which no coal is being charged into any of the coking chambers 9, the steam simply flows at relatively low speed through the housing of device 2 and is discharged via a conduit 7 to the main 4 or else, by operation of a valve 7*a*, via the conduit section shown in FIG. 2 in broken lines, to a not illustrated cooler in which it is fully condensed. This prevents excessive cooling of the steam in the device 2 and the objectionable formation of condensate in that device.

Shortly before a chamber 9 is to be charged with coal, a second valve 7*b* in conduit 7 is closed so that the steam can no longer escape through this conduit. The device 2 is now operatively connected with one or more of the charging holes 8*a* of the respective chamber and coal is charged into these holes. The steam flows from device 2 with the coal into the chamber 9 and, since it is at somewhat higher pressure than the oven gases in the chamber, prevents the entry of the oven gases into the device 2. From the chamber 9 the steam then travels, together with the evolving oven gases, via the outlet pipe 5 into the main 4, where it is condensed by water which is sprayed into the steam via inlets 10 leading to the main 4 and/or the pipe 5.

Resort to the inventive method assures that even during times in which no coal flows from bunker 1 to the ovens 8, or when there is a leak in the system due e.g. to a poor seal between the device 2 and the chute 3, the problems encountered in the prior art cannot occur. Of particular advantage is the fact that during the actual charging operation no dangerous gas mixtures can form in the device 2.

Theoretically it is, of course, possible to operate without steam over-pressure in the device 2, since the fact that steam flows through the device at all times (albeit without overpressure) should normally suffice to prevent the entry of air and/or coking gases or, if any does occur, to flush the entering gas quantities away before dangerous mixtures can form. However, operating with steam overpressure provides an increased margin of safety and is therefore currently preferred.

The quantity of superheated steam admitted into the housing of device 2 per unit time can be regulated with pressure and/or temperature regulating devices which are known per se. The flowspeed of the steam in the coal charging direction is of about the same order of magnitude as the travel speed of the coal, i.e. depending upon the type of conveying system used for the coal somewhere between about 0.2 and 3.0 m/sec. By admitting the steam at an appropriate empirically determined superheated temperature into the device 2, the heat loss occurring during flow of the steam through the device 2 can cool the steam down to just slightly above condensation temperature. Condensation thus is avoided in the device 2, but can readily take place in the main 4. This has, inter alia, the advantage that the product gas from the ovens 8 which, as is known is collected in the main 4, will not be thinned in any way.

While the invention has been illustrated and described as embodied in a method of preventing the entry of air and for other gases to a coke oven charging device.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of preventing the formation of explosive gas mixtures due to accidental entry of air and/or other gases into a mechanical charging device which has a mechanical conveyor which is surrounded by a housing and conveys coal directly from a bunker to and intermittently charges the coal into coke oven chambers through an outlet of the housing through which oven gases can enter the housing while air can enter through imperfect seals of the housing, comprising the steps of causing superheated steam to continuously flow directly through the housing of the mechanical conveyor in the coal conveying direction without performing coalcarrying functions; continuously discharging the steam from a downstream portion of the housing while no coal is being charged, and effecting condensation of the discharged steam outside the housing; and during charging of coal into a coke oven chamber admitting the steam with the coal through the outlet of the housing of the mechanical conveyor and into the chamber so that the steam blocks entry of gases through the outlet of the housing of the mechanical conveyor, and thereupon venting the steam into the coke oven main and effecting condensation of the steam.

2. A method as defined in claim 1, wherein the condensation of the steam outside the housing is effected by venting the steam to the coke oven main.

3. A method as defined in claim 1, wherein the condensation of the steam outside the housing is effected by venting the steam to a cooler.

4. A method as defined in claim 1, wherein the step of effecting condensation of the steam subsequent to venting from the housing, is effected by spraying cooling water into the steam.

5. A method as defined in claim 1, and further comprising the step of maintaining the pressure of the steam in the housing at a pressure which is in excess of at least one of the atmosphere pressure and coking gas pressure.

6. A method as defined in claim 1, wherein the step of causing the steam to flow comprises admitting the steam into the housing at a temperature so selected that heat loss during travel of the steam through the housing decreases the steam temperature not below a level near condensation temperature before the steam is discharged from the housing.

* * * * *